US008034283B2

(12) United States Patent
Tetsumoto et al.

(10) Patent No.: US 8,034,283 B2
(45) Date of Patent: Oct. 11, 2011

(54) ROTARY HEARTH FURNACE AND METHOD OF OPERATING THE SAME

(75) Inventors: Masahiko Tetsumoto, Kobe (JP); Sumito Hashimoto, Kobe (JP); Koji Tokuda, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 526 days.

(21) Appl. No.: 12/089,721

(22) PCT Filed: Oct. 31, 2006

(86) PCT No.: PCT/JP2006/321688

§ 371 (c)(1),
(2), (4) Date: Apr. 10, 2008

(87) PCT Pub. No.: WO2007/052621

PCT Pub. Date: May 10, 2007

(65) Prior Publication Data

US 2009/0160107 A1 Jun. 25, 2009

(30) Foreign Application Priority Data

Oct. 31, 2005 (JP) ..... 2005-316992

(51) Int. Cl.
*C21C 5/40* (2006.01)
*C21B 11/08* (2006.01)

(52) U.S. Cl. ..... 266/145; 110/203; 110/205; 110/210; 110/211; 110/214; 75/484; 266/144; 266/149

(58) Field of Classification Search ..... 110/203, 110/205, 210–211, 214; 75/484; 266/144–145, 266/149

See application file for complete search history.

(56) References Cited

U.S. PATENT DOCUMENTS

| | | | | |
|---|---|---|---|---|
| 6,482,351 | B2 * | 11/2002 | Kamikawa et al. | 266/156 |
| 2002/0027317 | A1 * | 3/2002 | Imaizumi | 266/168 |
| 2003/0037714 | A1 * | 2/2003 | Tetsumoto et al. | 110/342 |
| 2004/0201140 | A1 * | 10/2004 | Ibaraki et al. | 266/161 |

FOREIGN PATENT DOCUMENTS

| | | |
|---|---|---|
| JP | 11248359 | 9/1999 |
| JP | 2001 123211 | 5/2001 |
| JP | 2001 181720 | 7/2001 |
| JP | 2002 20813 | 1/2002 |
| JP | 2004 169140 | 6/2004 |

* cited by examiner

*Primary Examiner* — Roy King
*Assistant Examiner* — Lois Zheng
(74) *Attorney, Agent, or Firm* — Oblon, Spivak, McClelland, Maier & Neustadt, L.L.P.

(57) ABSTRACT

A rotary hearth furnace includes an exhaust gas eductor. The exhaust gas eductor includes a compartment-defining portion and an exhaust duct. The compartment-defining portion is provided on part of a ceiling of the rotary hearth furnace in an exhaust gas discharge region, and an exhaust duct is connected to the compartment-defining portion. The lower surface of the compartment-defining portion lies higher than the lower surface of the other portion of the ceiling. The compartment-defining portion defines a compartment where the exhaust gas stays. The exhaust duct can include a cooling medium injection nozzle. The furnace increases fuel efficiency by completely burning combustible components remaining in exhaust gas generated in the rotary hearth furnace so as to use the combustible components efficiently for the heating and reduction reaction in the rotary hearth furnace, without problems in producing reduced iron.

7 Claims, 3 Drawing Sheets

ROTARY HEARTH FURNACE AND METHOD OF OPERATING THE SAME

TECHNICAL FIELD

The present invention relates to a rotary hearth furnace and a method for operating the rotary hearth furnace, and more specifically to a technique for completely burning combustible exhaust gas generated in the rotary hearth furnace.

BACKGROUND ART

A known rotary hearth furnace includes an outer wall, an inner wall, and an annular rotary hearth disposed between the outer wall and the inner wall. The rotary hearth generally includes an annular furnace frame, a hearth heat insulation material disposed over the furnace frame, and a refractory disposed on the hearth heat insulation material. Such a rotary hearth is rotated by a mechanism. The rotating mechanism may be, for example, a gear mechanism including a rotating shaft disposed at the lower portion of the hearth, a pinion gear fixed to the rotating shaft so as to be rotated together with the rotating shaft, a rack rail circularly fixed to the bottom of the furnace frame and engaging with the pinion gear, or an apparatus including a track annularly laid on the surface of the hearth and a plurality of driving wheels disposed at the bottom of the furnace frame and running on the track.

Rotary hearth furnaces including such a mechanism can be used for heat treatment of metals, such as steel billet, or heat treatment of combustible wastes. In addition, a process that produces reduced iron from iron oxides in the rotary hearth furnace has come to attention. An example of the process for producing reduced iron in the rotary hearth furnace will now be described with reference to FIG. 6, which shows a schematic structure of the rotary hearth furnace.

(1) Iron oxide powder (iron ore, electric furnace dust, etc.) and carbonaceous reductant powder (coal, coke, etc.) are mixed and agglomerated, thereby forming green-pellets.
(2) The green pellets are heated in a range of temperatures at which combustible components evaporated from the pellets do not ignite. Water adhering to the green pellets is removed by this heating, and thus dried pellets 24 shown in FIG. 6 are produced.
(3) The dried pellets are fed into the rotary hearth furnace 26 by an appropriate charging device 23 shown in FIG. 6 and are spread on the rotary hearth 21 to form a pellet layer with a thickness defined by one or two pellets.
(4) The pellet layer is heated to be reduced by radiation of combustion in a burner 27 provided at an upper portion in the furnace. Thus, the pellet layer is metalized.
(5) The metalized pellets are cooled by a cooler 28. The cooling is performed by, for example, directly jetting a gas onto the pellets, or an indirect technique using a water-cooling jacket. The cooling gives the pellets such a mechanical strength as they can endure being handled while or after they are discharged. The cooled pellets (for example, reduced iron) 25 are discharged to the outside of the furnace by a discharging device 22.
(6) Immediately after the pellets 25 are discharged, the charging device 23 feeds other dried pellets. The sequence of these steps is repeated to produce reduced iron.

Combustible exhaust gas generated in the rotary hearth furnace used for producing reduced iron is drawn from an exhaust gas discharge region located on the circumference of the rotary hearth furnace to an exhaust duct connected to the ceiling of the exhaust gas discharge region, and is discharged to the outside of the system through an exhaust gas treatment apparatus disposed in the downstream from the exhaust duct. However, part of the combustible components remain in the exhaust gas drawn to the exhaust duct from the rotary hearth furnace. This is because the exhaust gas cannot be sufficiently mixed with oxygen in the rotary hearth furnace, so that the combustible components cannot be completely burned.

Accordingly, in general, secondary combustion air is supplied into the furnace so that the combustible gas can be burned with the secondary combustion air to reduce fuel consumption. However, the supply of the secondary combustion air excessively increases the amount of air in the furnace. The excess of the air not only reduces the temperature in the furnace, but also inhibits the reduction reaction or causes reoxidation.

A metal reduction process using an apparatus as shown in FIG. 7 has been known for controlling the secondary combustion. FIG. 7 shows a horizontal section of this apparatus. The apparatus includes a rotary hearth furnace having a heating zone 30 and a reducing zone 40, a gas analyzer 31, and an air intake means 34. The gas analyzer 31 samples the gas from the heating zone 30 of the furnace and measures the $O_2$ or CO concentration in the gas. The air intake means 34 introduces air into the heating zone 30 according to the concentration measured by the gas analyzer 31, so that the unburned combustibles generated in the reducing zone 40 are burned.

This apparatus, however, cannot sufficiently mix and agitate the secondary combustion air and the combustible gas or ensure residence time sufficient to burn the combustible gas, even if a sufficient amount of air for the secondary combustion is introduced to the heating zone 30. Accordingly, the unburned combustibles may not be completely burned in the region where heat of combustion should be used efficiently. In other words, because the known apparatus cannot sufficiently mix or agitate the unburned combustibles and the secondary combustion air in the furnace, the unburned combustibles do not burn completely. Thus, part of the unburned combustibles are drawn to the exhaust duct without being burned. This phenomenon causes not only the decrease of the fuel efficiency of the rotary hearth furnace, but also damages to equipment, such as the exhaust duct, from the combustion of the unburned combustibles in the exhaust duct and the increase of its temperature. Furthermore, ash and other components contained in the exhaust gas with a high temperature may be melted and adhere to the duct, thus clogging the duct.

DISCLOSURE OF INVENTION

The object of the present invention is to increase the fuel efficiency of a rotary hearth furnace by completely burning combustible components remaining in exhaust gas generated in the rotary hearth furnace so as to use the combustible components efficiently for the heating and reduction reaction in the rotary hearth furnace, without problems in producing reduced iron.

In order to accomplish the object, the present invention provides a rotary hearth furnace including an outer wall and an inner wall; a rotary hearth and a ceiling disposed between the outer wall and the inner wall; and a compartment-defining portion and an exhaust duct. The compartment-defining portion is provided on part of the ceiling along the rotation direction of the rotary hearth, has a lower surface lying higher than the lower surface of the other portion of the ceiling, and defines a compartment inside. The exhaust duct is connected to the compartment-defining portion so as to communicate with the compartment.

BEST MODE FOR CARRYING OUT THE INVENTION

Figure 1:
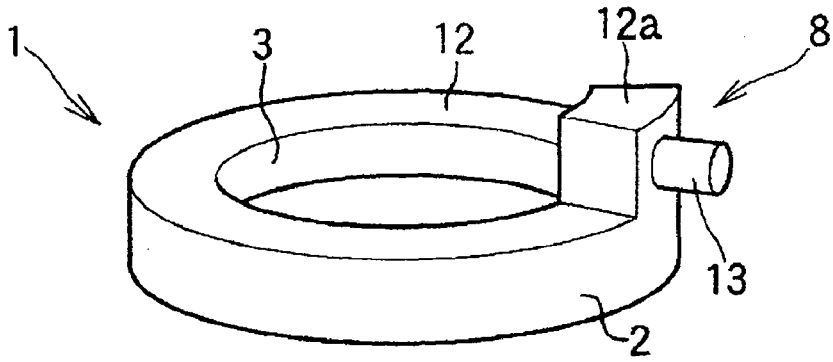
FIG. 1 is a perspective view of the entire appearance of a rotary hearth furnace according to an embodiment of the present invention.
Figure 2:
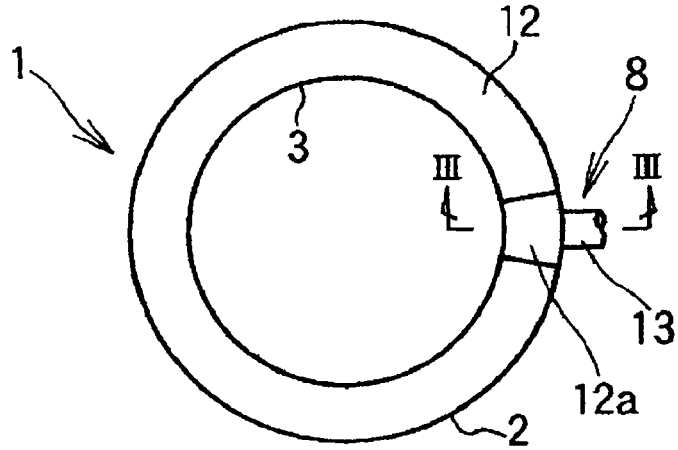
FIG. 2 is a plan view of the entirety of the rotary hearth furnace.

Preferred embodiments of the present invention will now be described with reference to FIGS. 1 to 5.

FIGS. 1 to 5 show a rotary hearth furnace 1. The rotary hearth furnace 1 includes an outer wall 2, an inner wall 3, a ceiling 12 covering the space between the outer wall 2 and the inner wall 3 from above, and an annular rotary hearth 10 disposed between the outer wall 2 and the inner wall 3. The outer wall 2, the inner wall 3, and the ceiling 12 are made of a heat insulation material mainly.

The rotary hearth 10 is driven by a not shown driving device so as to rotate through the space between the outer wall 2 and the inner wall 3. The rotary hearth 10 includes an annular furnace frame 4, a hearth heat insulation material 5 disposed on the furnace frame 4, and a refractory 6 disposed on the hearth heat insulation material 5. Agglomerated pellets 7 made of iron oxide and a carbonaceous reducer are introduced onto the heat insulation material 5 through a not shown charging hole. The agglomerated pellets 7 are heat-treated and reduced in the furnace with the rotary hearth 10 rotating. Thus, reduced iron is produced.

The rotary hearth furnace 1 has an exhaust gas eductor 8. The exhaust gas eductor 8 includes a compartment-defining portion 12*a* for defining a compartment 9 in the rotary hearth furnace 1 and an exhaust duct 13 connected to the compartment-defining portion 12*a*.

The compartment-defining portion 12*a* is provided on the ceiling 12 to define a part of the ceiling 12 along the circumferential direction (or the rotation direction of the rotary hearth 10). The compartment-defining portion 12*a* protrudes upward from the ceiling 12, and the lower surface of the compartment-defining portion lies higher than the lower surface of the other portion of the ceiling 12. Thus, the compartment-defining portion 12*a* defines the compartment 9 inside so as to form an upward recess extending from another space in the furnace.

The compartment-defining portion 12*a* is formed on part of the ceiling 12 along the rotation direction of the rotary hearth 10, and more specifically in the region corresponding to an exhaust gas discharge region 11 to which the exhaust duct 13 should been connected. The exhaust duct 13 is horizontally connected to the compartment-defining portion 12*a* to communicate with the compartment 9.

The compartment 9 allows the exhaust gas generated in the furnace to stay until the exhaust gas reaches the exhaust duct 13. More specifically, the compartment 9 has a sufficient capacity in which combustible components remaining in the exhaust gas can be burned within the residence time of the exhaust gas (time until the exhaust gas reaches the exhaust duct 13).

Figure 3:
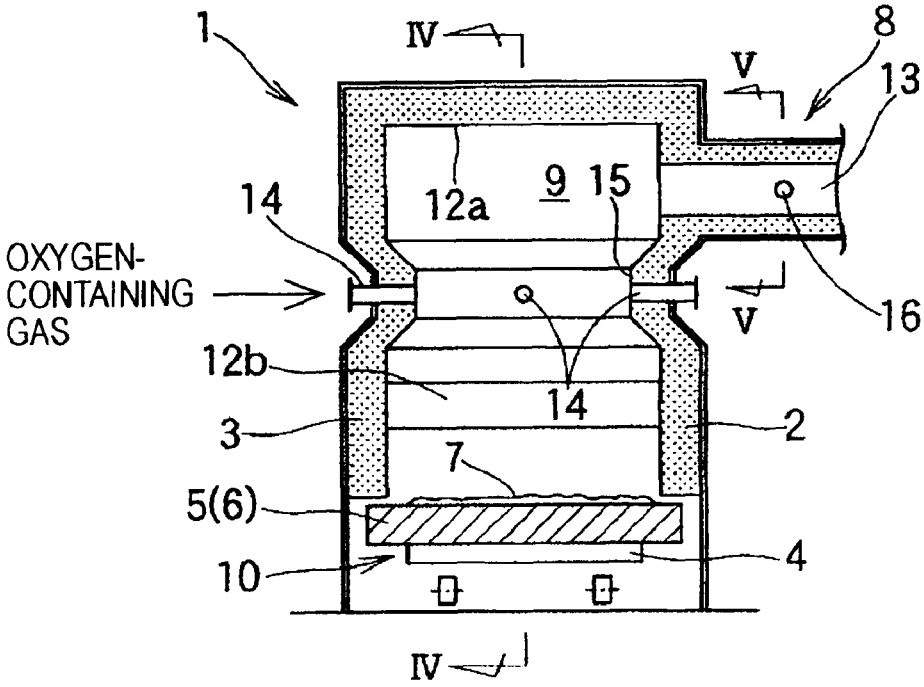
FIG. 3 is a sectional elevational view taken along line III-III of FIG. 2.
Figure 4:
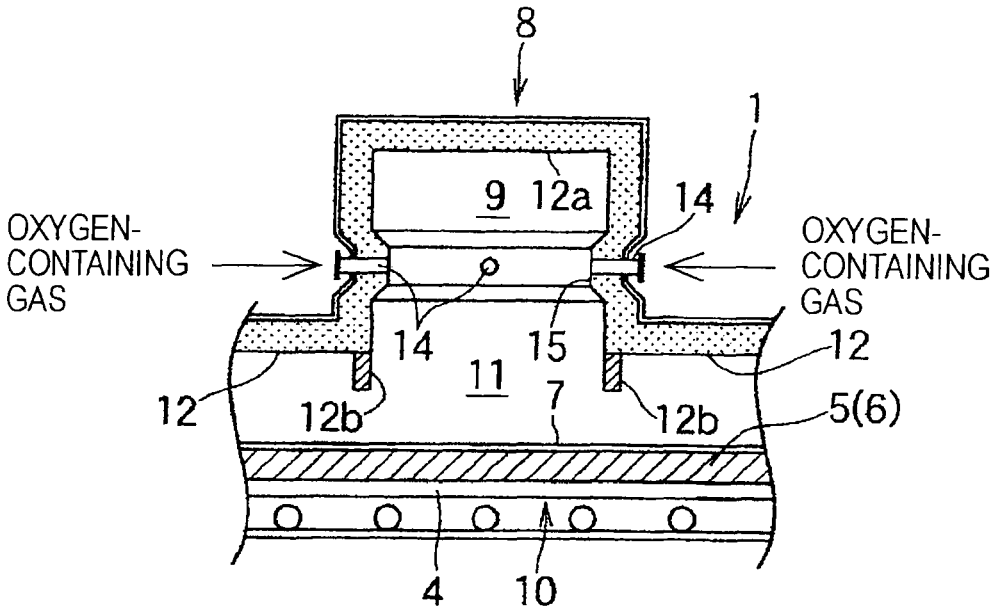
FIG. 4 is a sectional elevational view taken along line IV-IV of FIG. 3.

In order to ensure sufficient residence time, preferably, baffle walls 12*b* are provided downward at the ends in the circumferential direction of the compartment-defining portion 12*a* to separate the compartment 9 from the other space in the furnace, as shown in FIGS. 3 and 4. Preferably, the capacity of the compartment 9 is set so that the exhaust gas can stay in the compartment 9 for at least 0.5 seconds.

The exhaust gas eductor 8 of the present embodiment also has a narrowing portion 15 as shown in FIGS. 3 and 4. The narrowing portion 15 is provided at the entrance to the compartment 9. The narrowing portion 15 provided at the entrance to the compartment 9 allows the exhaust gas coming into the compartment 9 to form a turbulent flow. The turbulent flow promotes the agitation of the combustible components remaining in the exhaust gas and oxygen contained in the exhaust gas. By promoting the agitation of the combustible components and the oxygen, the combustible components can be efficiently brought into contact with oxygen to burn completely.

The narrowing portion 15 refers to a portion reducing the cross section of the entrance through which the exhaust gas comes into the compartment 9, and serves to agitate the exhaust gas that has come into the compartment 9.

In the present embodiment, a plurality of oxygen-containing gas injection nozzles 14 through which an oxygen-containing gas blows in are provided to the compartment-defining portion 12*a* (the narrowing portion 15 in the case shown in the figures). These oxygen-containing gas injection nozzles 14 supply oxygen-containing gas to the compartment 9 in an amount sufficient to completely burn combustible components remaining in the exhaust gas discharged from the rotary hearth furnace 1. The blowing of oxygen-containing gas can promote the agitation and mixing of the exhaust gas, so that combustible components in the exhaust gas are burned more efficiently. The oxygen-containing gas injection nozzles 14 may be disposed through the narrowing portion 15 as shown in the figures, or in the vicinity apart from the narrowing portion 15 in the vertical direction. The nozzles 14 may be provided to a compartment-defining portion not having the narrowing portion 15.

Preferably, the oxygen-containing gas injection nozzle 14 is provided to the narrowing portion 15 so that the oxygen-containing gas is jetted at a tilt angle with respect to the space defining the compartment 9. This arrangement forms a spiral flow in the compartment 9, promotes the agitation of the combustible gas and the oxygen-containing gas, and extends the residence time of the exhaust gas in the compartment 9.

The amount of the oxygen-containing gas should be controlled so that the temperature in the compartment 9 is lower or equal to the allowable temperature limit of the refractory of the compartment 9. The oxygen-containing gas can be air, which is most easily available.

Figure 5:
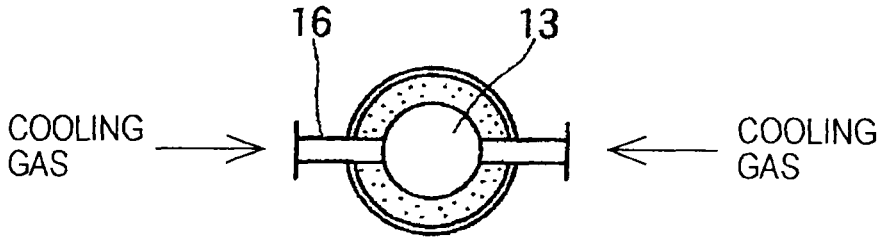
FIG. 5 is a sectional view taken along line V-V of FIG. 3.
Figure 6:
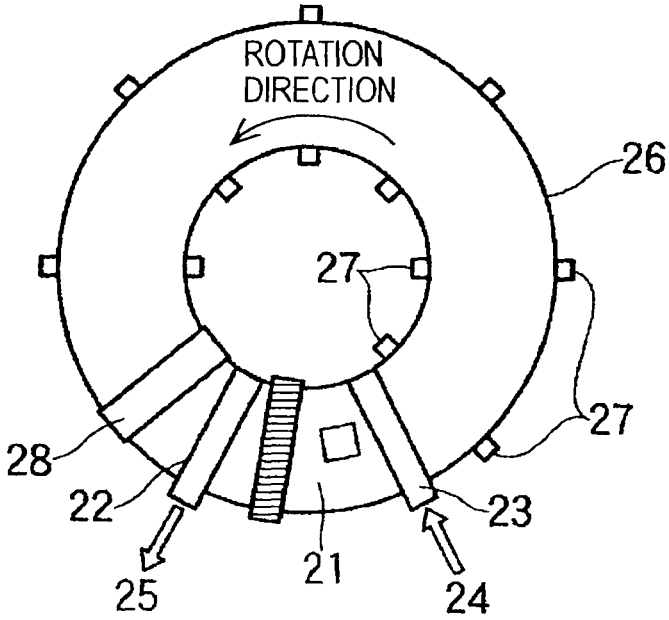
FIG. 6 PRIOR ART
FIG. 6 is a fragmentary sectional plan view of the hearth of a known rotary hearth furnace.
Figure 7:
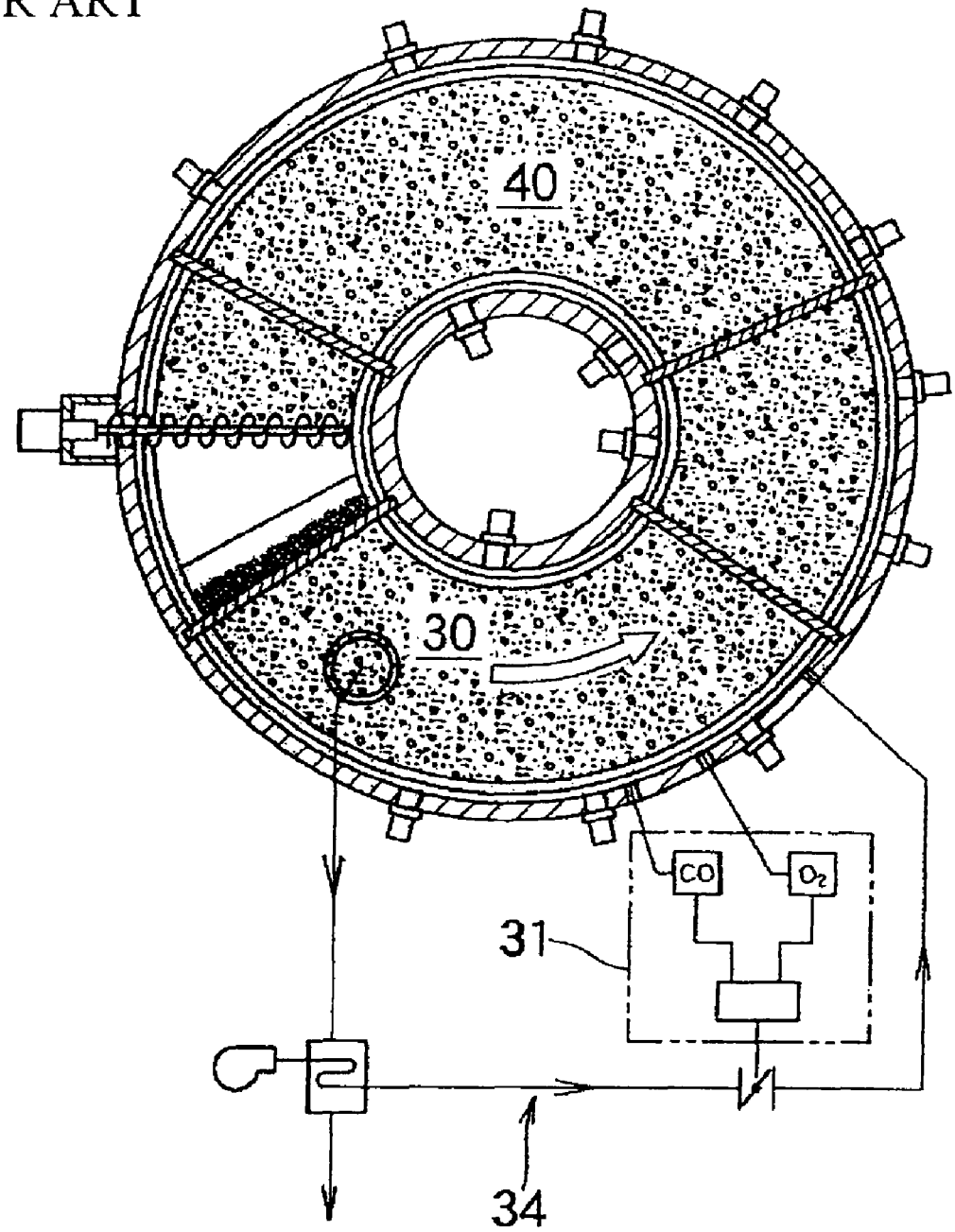
FIG. 7 PRIOR ART
FIG. 7 is a sectional plan view of the hearth of another known rotary hearth furnace.

More preferably, a plurality of cooling medium injection nozzles 16 are provided to the exhaust duct 13 of the exhaust gas eductor 8, as shown in FIGS. 3 and 5. These cooling medium injection nozzles 16 are intended to feed a cooling medium to the exhaust gas. The feeding of the cooling medium reduces the temperature of the exhaust gas, and consequently reduces damages from high temperature and adhesion of ash and other components to the duct or other equipment. It is therefore preferable that the cooling medium injection nozzle 16 be disposed close to an exhaust gas outlet 11 of the exhaust duct 13 as much as possible. The number of the cooling medium injection nozzles 16 may be one.

Air, which is most easily available, can be used as the cooling medium. Exhaust gas with a temperature of room temperature or less discharged from another plant may be also used as the cooling gas. As an alternative to such cooling gases, cooling water may be sprayed into the exhaust duct 13 through the cooling medium injection nozzles 16 to increase the cooling efficiency. The amount of the cooling medium is preferably controlled so that the temperature of the exhaust gas is reduced to a temperature lower than or equal to the softening points or melting points of ash components or the like.

As described above, a rotary hearth furnace is provided which includes an outer wall, an inner wall, and a rotary hearth and a ceiling disposed between the outer wall and the inner wall, and which further includes a compartment-defining portion and an exhaust duct. The compartment-defining portion is provided on part of the ceiling along the rotation direction of the rotary hearth, having a lower surface at a higher position than the position of the lower surface of the other portion of the ceiling, and defines a compartment inside. The exhaust duct is connected to the compartment-defining portion so as to communicate with the compartment. Combustible components remaining in the exhaust gas are completely burned during staying in the compartment. This complete combustion efficiently helps the heating and reduction reaction in the rotary hearth furnace and thus increases the fuel efficiency without problems in producing reduced iron.

In the rotary hearth furnace, more preferably, a narrow portion is formed at the entrance to the compartment. The narrow portion allows the exhaust gas to form a turbulent flow and helps agitate the combustible components and oxygen remaining in the exhaust gas, thus efficiently bringing both gases into contact with each other. Thus, the complete combustion of the combustible components can be ensured more certainly.

More preferably, in the rotary hearth furnace, an oxygen-containing gas injection nozzle is provided to the compartment-defining portion, and through which an oxygen-containing gas is fed into the compartment. Preferably, the amount of oxygen-containing gas is set so that the combustible components remaining in the exhaust gas discharged from the rotary hearth furnace are completely burned. The operation of such a rotary hearth furnace, if it has a heating zone and a reducing zone, prevents the heating zone from coming to a reducing atmosphere due to lack of oxygen, or the reducing zone from coming to an oxidizing atmosphere due to oxygen excess, and allows combustible components to be completely burned and subsequently discharged through the exhaust duct.

The complete combustion of unburned combustibles in the furnace may increase the temperature of the exhaust gas discharged from the furnace, so that ash or other components contained in the exhaust gas are softened or melted and adhere to the exhaust duct to clog it. However, this phenomenon can be prevented by rapidly cooling the exhaust gas to a temperature lower than or equal to the softening point or melting point of the ash and other components immediately after the exhaust gas is discharged from the compartment of the furnace. For this purpose, an apparatus having a cooling medium injection nozzle through the exhaust duct is suitably used. A cooling medium is fed to the exhaust gas through the cooling medium injection nozzle to reduce the temperature of the exhaust gas, and thus reduces damages from high temperature and adhesion of the ash and other components to the equipment.

The invention claimed is:

1. A rotary hearth furnace comprising:

an outer wall;

an inner wall disposed at the inner side of the outer wall;

a ceiling covering a space between the outer wall and the inner wall from above;

a rotary hearth disposed between the outer wall and the inner wall;

a compartment-defining portion provided on part of the ceiling along the rotation direction of the rotary hearth;

an exhaust duct connected to the compartment-defining portion, wherein the ceiling in the compartment-defining portion has a lower surface lying higher than the lower surface of the ceiling other than in the compartment-defining portion, and defines a compartment therein for allowing exhaust gas generated in the rotary hearth furnace to stay until the exhaust gas is introduced into the exhaust duct, wherein the compartment has a sectional area, in a section transverse to the direction of flow of the exhaust gas therein, greater than the sectional area of the exhaust duct in a section transverse to the direction of flow of the exhaust gas therein, and wherein the exhaust duct is connected to the compartment-defining portion so as to communicate with the compartment; and a plurality of oxygen-containing gas injection nozzles provided to the compartment-defining portion at a plurality of positions around the compartment, through which an oxygen-containing gas may be fed into the compartment.

2. The rotary hearth furnace according to claim 1, wherein the compartment-defining portion has a narrowing portion at an entrance to the compartment, and the narrowing portion reduces the cross section of a flow path through which exhaust gas flows into the compartment so that the cross section at the narrowing portion is smaller than the cross sections of the other portions of the flow path.

3. The rotary hearth furnace according to claim 2, wherein the oxygen-containing gas injection nozzles are provided to the narrowing portion or in the vicinity thereof.

4. The rotary hearth furnace according to claim 1, further comprising a cooling medium injection nozzle through which a cooling medium may be fed into the exhaust duct, the cooling medium injection nozzle being provided to the exhaust duct.

5. A method for operating the rotary hearth furnace as set forth in claim 1, wherein the oxygen-containing gas is fed into the compartment through the oxygen-containing gas injection nozzle in an amount sufficient to completely burn combustible components remaining in exhaust gas discharged from the rotary hearth furnace.

6. The rotary hearth furnace according to claim 1, wherein a capacity of the compartment is sufficient that combustible components in the exhaust gas are burned in the compartment during the residence time of the exhaust gas in the compartment.

7. A rotary hearth furnace comprising:

an outer wall;

an inner wall disposed at the inner side of the outer wall;

a ceiling covering a space between the outer wall and the inner wall from above;

a rotary hearth disposed between the outer wall and the inner wall;

a compartment-defining portion provided on part of the ceiling along the rotation direction of the rotary hearth;

an exhaust duct connected to the compartment-defining portion, wherein the ceiling in the compartment-defining portion has a lower surface lying higher than the lower surface of the ceiling other than in the compartment-defining portion, and defines a compartment therein for allowing exhaust gas generated in the rotary hearth furnace to stay until the exhaust gas is introduced into the exhaust duct, and wherein the exhaust duct is connected to the compartment-defining portion so as to communicate with the compartment; and a plurality of oxygen-containing gas injection nozzles through which an oxygen-containing gas is fed into the compartment, the oxygen-containing gas injection nozzles being provided to the compartment-defining portion, wherein the oxygen-containing gas injection nozzles are provided at a plurality of positions around the compartment, and each oxygen-containing gas injection nozzle is disposed at an angle with respect to the direction toward the center of the compartment so that oxygen-containing gas is jetted in a direction biased toward the direction perpendicular to the direction in which the exhaust gas is introduced.

* * * * *